US011302506B1

(12) United States Patent
Drotar et al.

(10) Patent No.: US 11,302,506 B1
(45) Date of Patent: Apr. 12, 2022

(54) HIGH VOLTAGE FUSE ADAPTER SYSTEM AND METHOD

(71) Applicant: Norberg-IES, LLC, Tulsa, OK (US)

(72) Inventors: William G. Drotar, Tulsa, OK (US); Lee Roy Burris, Mannford, OK (US)

(73) Assignee: Norberg-IES, LLC, Tulsa, OK (US)

( * ) Notice: Subject to any disclaimer, the term of this patent is extended or adjusted under 35 U.S.C. 154(b) by 0 days.

(21) Appl. No.: 17/235,181

(22) Filed: Apr. 20, 2021

Related U.S. Application Data

(60) Provisional application No. 63/012,558, filed on Apr. 20, 2020.

(51) Int. Cl.

| | |
|---|---|
| ***H01H 85/22*** | (2006.01) |
| ***H01H 85/50*** | (2006.01) |
| ***H01H 85/30*** | (2006.01) |
| ***H01H 85/042*** | (2006.01) |

(52) U.S. Cl.
CPC ..... *H01H 85/22* (2013.01); *H01H 85/042* (2013.01); *H01H 85/303* (2013.01); *H01H 85/50* (2013.01)

(58) Field of Classification Search
CPC .... H01H 85/042; H01H 85/157; H01H 85/22; H01H 85/30; H01H 85/303; H01H 85/32; H01H 85/50; H01H 2085/207
See application file for complete search history.

(56) References Cited

U.S. PATENT DOCUMENTS 2,704,840 A * 3/1955 Ward ..... G08B 17/06 340/508
2,726,378 A * 12/1955 Norcross ..... H01H 85/306 340/638
2,855,483 A * 10/1958 Swing ..... H01H 85/306 337/195
3,183,327 A * 5/1965 Kozacka ..... H01H 85/303 337/219
3,246,106 A * 4/1966 Sommers ..... H01H 85/47 337/209
4,981,448 A * 1/1991 Herbert ..... H01H 85/542 439/620.29
5,085,600 A * 2/1992 Damron ..... H01H 85/20 439/620.28

(Continued)

*Primary Examiner* — Jacob R Crum
(74) *Attorney, Agent, or Firm* — Frederic Dorwart, Lawyers PLLC; Penina Michlin Chiu

(57) ABSTRACT

A high voltage fuse adapter system and method. A fuse adapter system includes an indicator-end adapter configured to circumferentially enclose an indicator-end terminal of a high voltage IEC rated fuse, including a hollow portion having an inner diameter that surrounds the indicator-end terminal, the hollow portion including at least one axially extending slot compressible around the indicator-end terminal, and an indicator portion, a piston and needle enclosed within the indicator portion, the piston and needle coupled to a striker of the high voltage IEC-rated fuse such that upon extension of the striker, the piston at least partially actuates the needle outside of the indicator-end adapter, a non-indicator-end adapter configured to circumferentially enclose a non-indicator-end terminal of the high voltage fuse, and a pair of end caps enclosing the indicator-end adapter and the non-indicator end adapter to form an adapted fuse configured to fit in an UL-style fuse mounting.

18 Claims, 7 Drawing Sheets

(56) References Cited

U.S. PATENT DOCUMENTS

| | | | | |
|---|---|---|---|---|
| 7,717,750 | B1 * | 5/2010 | Layer | H01H 85/20<br>439/620.26 |
| 2010/0039789 | A1 * | 2/2010 | Mason | H01H 85/20<br>361/833 |
| 2012/0056708 | A1 * | 3/2012 | Ventura | H01H 9/104<br>337/207 |
| 2012/0161919 | A1 * | 6/2012 | von zur Muehlen | H01H 85/201<br>337/228 |
| 2016/0372291 | A1 * | 12/2016 | Darr | H01H 71/20 |
| 2021/0175657 | A1 * | 6/2021 | Holtz | H01R 13/111 |

* cited by examiner

HIGH VOLTAGE FUSE ADAPTER SYSTEM AND METHOD

CROSS REFERENCE TO RELATED APPLICATIONS

This application claims the benefit of U.S. Provisional Application No. 63/012,558 to Drotar et al., filed Apr. 20, 2020 and entitled "HIGH VOLTAGE FUSE ADAPTER SYSTEM AND METHOD," which is hereby incorporated by reference in its entirety.

BACKGROUND OF THE INVENTION

1. Field of the Invention

Embodiments of the invention described herein pertain to the field of high voltage electrical fuses. More particularly, but not by way of limitation, one or more embodiments of the invention enable a high voltage fuse adapter system and method.

2. Description of the Related Art

An electrical fuse is a safety device that operates to provide overcurrent protection of an electrical circuit. The fuse's essential component is a metal wire or strip that melts when too much current flows through the fuse, thereby stopping or interrupting the current and preventing damage to other valuable equipment in the circuit.

Fuses above 600 Volts are considered high voltage, and are conventionally used in industrial applications that require electricity in large quantities, such as refineries, pulp mills and paper mills. In North America, high voltage fuses are typically incorporated into disconnect switches.

In North America, the Institute of Electrical and Electronic Engineers Inc. (IEEE) and the National Electrical Manufacturers Association (NEMA) set standards for fuses. E-Rated fuses have defined current response times specified by ANSI C37.46. E-Rated fuses 100 Amps and below must melt in 300 seconds at a Root Mean Square (RMS) current within the range of 200% to 240% of the continuous current rating. E-Rated fuses above 100 Amps must melt in 600 seconds at a RMS current within the range of 240% to 264% of the continuous current rating of the fuse. E-Rated fuses are used to protect feeder circuits, power transformers and potential transformers.

Many high voltage fuse disconnect switches currently require 15,000 Volt fuses. Previously in North America, a single E-rated fuse made of filament wound fiberglass had been used in such circumstances, mounted in an Underwriters Laboratory (UL) style single-fuse mounting. However, due to heat dissipation problems, use of single E-rated fuses have been discontinued. This leaves legacy disconnect switches with UL style single-barrel mountings, but no fuses that are able to handle the current carrying specifications and also fit within the UL style single-barrel mounting.

Presently, at current levels exceeding 100 Amps, two E-rated 15,000 Volt fuses per phase, mechanically attached together, are required to meet the current carrying specifications due to the low melting temperature of the filament wound fiberglass fuse body. Unfortunately, legacy equipment would need to be retrofit to replace the single-fuse UL mounting block with a double-fuse UL mounting, since double fuse clips do not fit within existing mounting blocks designed for a single fuse. Retrofitting the mounting blocks can cost tens of thousands of dollars due to system downtime required during the retrofit, and the need to hire an electrician. In addition, E-rated high voltage fuses are expensive, typically costing in the range of $2,000 USD per fuse as of this writing, and two such fuses are now required instead of one. FIG. 1 illustrates a conventional double barrel E-rated fuse arrangement of the prior art.

International Electrotechnical Commission (IEC) rated fuses are standardized fuses used in Europe and locations outside of North America. IEC fuses are made of ceramic with a much higher melting temperature, as opposed to filament wound fiberglass, and are therefore able to run more current than North American E-rated fuses. A single IEC standard fuse costs about half of a single E-rated fuse, and would be capable of handling the necessary 200 Amps at 15,000 Volts required for North American E-rated fuses. Unfortunately, the IEC fuses are not the right shape or size to fit into a UL style single-fuse mounting used in North American circuitry. A standardized IEC fuse of the prior art is shown in FIG. 2. Comparing FIG. 2 to the North American style fuse shown in FIG. 1, one can see the shape and size difference of the two styles of fuse and why they are not compatible or interchangeable.

For new applications, the ability to use a single fuse, instead of a double fuse arrangement would save cost, materials and space.

As is apparent from the above, North American fuses for high voltage fuse disconnect switches require two, wound filament-style fuses per phase in a UL type fuse mounting. These fuses are expensive at $2,000 each, and the double-barrel fuse mounting does not fit into legacy equipment designed for a single fuse per phase. It would be desirable and less expensive if a single IEC fuse could be used in a UL style singe-fuse mounting. Doing so would save material, save space and achieve significant cost savings. Therefore, there is a need for a high voltage fuse adapter system and method that would allow a single IEC fuse to be used in a North American fuse clip.

BRIEF SUMMARY OF THE INVENTION

One or more embodiments of the invention enable a high voltage fuse adapter system and method.

A high voltage fuse adapter system and method is described. An illustrative embodiment of a high voltage fuse adapter system includes an indicator-end adapter configured to circumferentially enclose an indicator-end terminal of a high voltage International Electrotechnical Commission (IEC)-rated fuse, including a hollow portion having an inner diameter that surrounds the indicator-end terminal, the hollow portion including at least one axially extending slot compressible around the indicator-end terminal, and an indicator portion, a piston and needle enclosed within the indicator portion, the piston and needle coupled to a striker of the high voltage IEC-rated fuse such that upon extension of the striker, the piston at least partially actuates the needle outside of the indicator-end adapter, a non-indicator-end adapter configured to circumferentially enclose a non-indicator-end terminal of the high voltage fuse, and a pair of end caps enclosing the indicator-end adapter and the non-indicator end adapter to form an adapted fuse, wherein the adapted fuse is configured to fit in an Underwriters Laboratory (UL)-style fuse mounting. In some embodiments, the hollow portion of the indicator-end adapter covers the indicator-end terminal. In certain embodiments, a first end cap of the pair of end caps encloses the indicator-end adapter, the first end cap having an opening, and wherein the needle extends through the opening when actuated by the piston. In some embodiments, the hollow portion mates with the indicator-end terminal, and the indicator portion extends on an outward side of the indicator-end adapter. In certain embodiments, the at least one axially extending slot includes two axially extending slots arranged 180 degrees apart. In some embodiments, the indicator-end adapter and the non-indicator-end adapter are silver plated. In certain embodiments, the piston is threadedly connected to the needle, and the piston extends circumferentially around an outer diameter of the striker. In some embodiments, the at least one axially extending slot is compressible by at least one radially-oriented screw extending through an aperture in the indicator-end adapter. In certain embodiments, the high voltage IEC-rated fuse is an IEC standardized Ferrule-style fuse of 15.5 kV and one of 125, 150, 175 or 200 Amperes. In some embodiments, the UL-style fuse mounting is a CLE/CLS UL style fuse clip mounting. In certain embodiments, the non-indicator end adapter further includes a second at least one axially extending slot compressible around the non-indicator-end terminal.

An illustrative embodiment of a method of employing a single International Electrotechnical Commission (IEC) fuse in an Underwriters Laboratory (UL)-style fuse mounting, including enclosing an indicator-end of the single IEC fuse inside a first adapter piece that lengthens and widens the indicator-end, coupling a piston and needle to a striker of the single IEC fuse such that the needle is visible outside the adapter when the single IEC fuse breaks, and enclosing the non-indicator-end of the single IEC fuse inside a second adapter piece, capping the first and second adapter pieces with end caps, and mounting the single IEC fuse with adapters and end caps into the UL-style mounting. In some embodiments, the method further includes compressing the first adapter piece around the indicator end to mate a hollow portion of the adapter piece to the indicator end. In certain embodiments, the striker of the single IEC fuse actuates the needle at least partially out of the adapter when the single IEC fuse breaks. In some embodiments, the method further includes silver-plating the first and second adapter piece. In certain embodiments, the method further includes taking a resistance reading subsequent to enclosing the indicator-end and the non-indicator end of the single IEC fuse inside the first adapter piece and the second adapter piece. In some embodiments, the method further including employing the mounted single IEC fuse in a phase of a North American style disconnect switch.

An illustrative embodiment of a system for utilizing an International Electrotechnical Commission (IEC)-rated fuse in North American style equipment includes a pair of adapter pieces that compressibly mate around respective terminals of the IEC-rated fuse such that the IEC-rated fuse is configured to fit within a pair of Underwriters Laboratory (UL) standard fuse caps and an indicator is visible outside at least one adapter piece of the pair of adapter pieces and its corresponding UL standard fuse cap upon overload of the IEC rated fuse.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
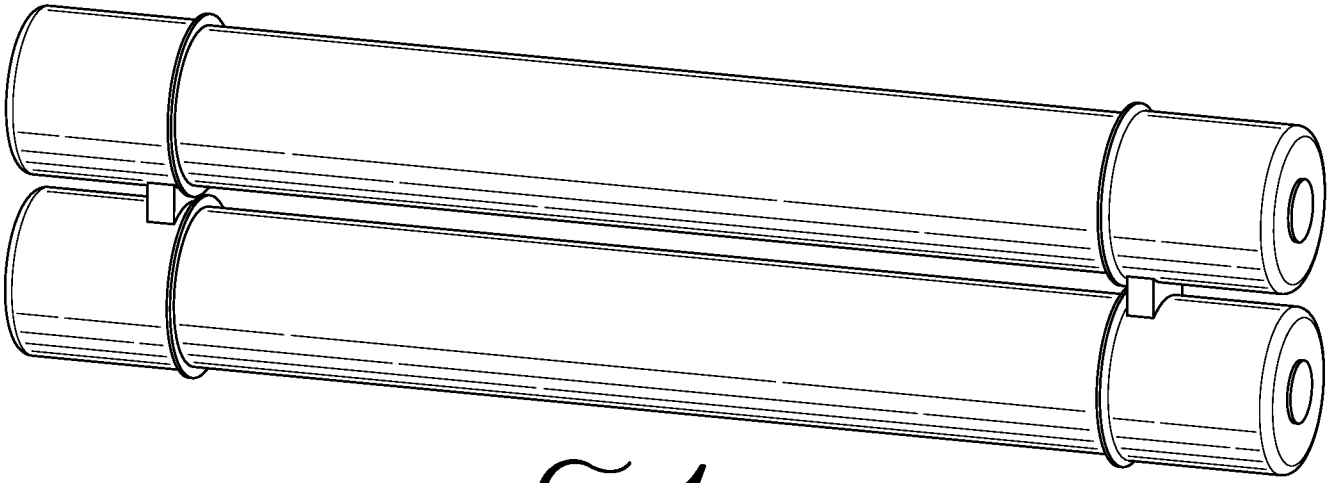
Fig. 1 PRIOR ART
FIG. 1 is a perspective view of a North American style double fuse arrangement of the prior art.
Figure 2:
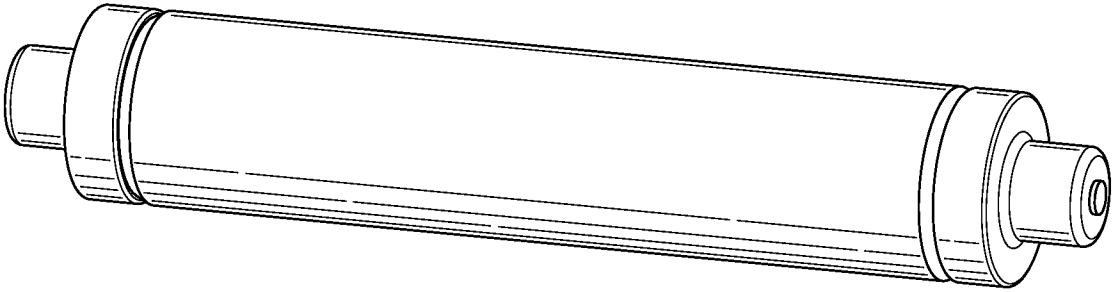
Fig. 2 PRIOR ART
FIG. 2 is a perspective view of a standardized IEC fuse of the prior art.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A high voltage fuse adapter system and method will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms “a”, “an” and “the” include plural referents unless the context clearly dictates otherwise. Thus, for example, reference to a slot includes one or more slots.

As used in this specification and the appended claims, "high voltage" means 600 Volts or above.

As used in this specification and the appended claims, "coupled" refers to either a direct connection or an indirect connection (e.g., at least one intervening connection) between one or more objects or components. The phrase "directly attached" means a direct connection between objects or components.

In the art, a 15,000 Volt fuse is sometimes referred to as a 15.5 kV fuse. Both such terms are used interchangeably to refer to a fuse able to withstand up to 15.5 kV.

One or more embodiments of the invention provide a high voltage fuse adapter. While for ease of description and so as not to obscure the invention, illustrative embodiments are described in terms of a 15,000 Volt fuse, nothing herein is intended to limit the invention to that embodiment. The invention may be applied equally to fuses with other voltages and currents.

Since the discontinuation of single E-rated fuses, resellers and end-users of high voltage fuses have recognized a need to replace the double-barrel design required for 15,000 Volt E-rated fuses in North America with a less-expensive, lower footprint alternative that continues to operate reliably and does not interfere with the functioning of the overload indicator. Illustrative embodiments may solve this need by, and may include, a high voltage fuse adapter. The adapter of illustrative embodiments may modify a single IEC fuse to fit into a UL style single-barrel mounting in high voltage embodiments. A piston and needle of illustrative embodiments coupled to the striker of the IEC fuse may provide a visible indication of overload despite the striker being covered inside the adapter of illustrative embodiments. The adapter allows a single fuse per phase to be employed, rather than a set of two North American style fuses. Using a single fuse per phase amounts to considerable cost savings since it obviates the need to replace mounting blocks in legacy equipment. A single IEC fuse also has a smaller footprint than the double barrel design, thus saving space and material in newbuild applications. In addition, as of the date of this writing, a single high voltage fuse costs approximately $2,000 USD, and an IEC fuse costs about half of one E-rated fuse.

Illustrative embodiments may include a pair of adapter pieces that attach to the indicator and non-indicator side of an IEC fuse. Each adapter piece may be cylindrical in shape with a hollow portion, slotted and screwed, snapped and/or fit tightly around the terminal ends of the fuse. The adapter pieces may increase the length and width of the terminal ends of the IEC fuse such that the IEC fuse can accommodate a three-inch diameter fuse cap, which is the UL standard that matches fuse clip dimensions of the single barrel UL design used in North American applications. The fuse caps, which may also be called end caps, may be placed over each adapter prior to mounting. Thus, making illustrative embodiments "plug and play". The indicator-side adapter piece may include an internal piston and needle that aligns with the striker of the IEC fuse. Should the fuse become overloaded and the striker be triggered, the striker may hit, push and/or move the piston, and the needle may extend out of the adapter body as a visible indicator of overload. The adapter pieces of illustrative embodiments may be silver plated after machining and prior to assembly to ensure good electrical conductivity. A resistance reading of the fuse may be conducted prior to assembly and after assembly to ensure the characteristic of the final product has not been changed and provide the user with confidence that the adapter is functioning properly.

Figure 3A:
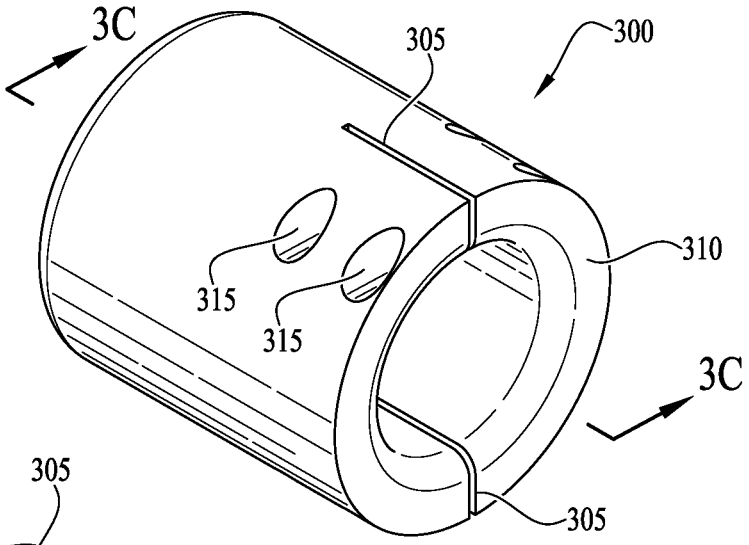
FIG. 3A is a perspective as viewed from the inward side of an indicator-end adapter piece of an illustrative embodiment.
Figure 3B:
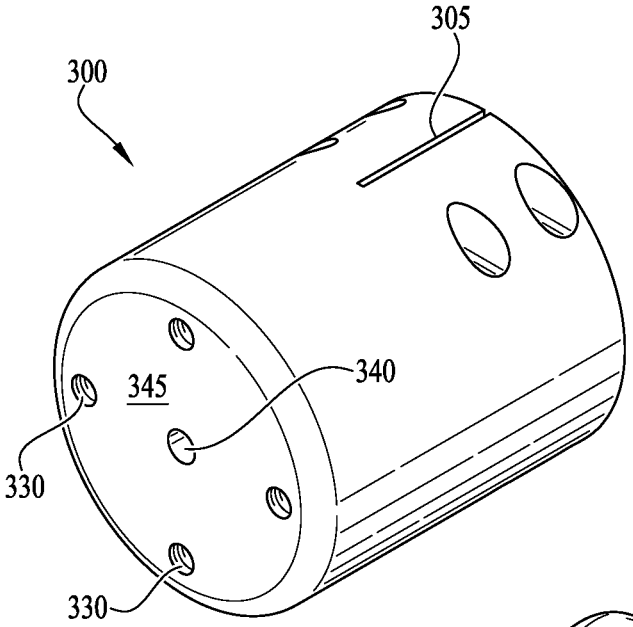
FIG. 3B is a perspective as viewed from the outward side of an indicator-end adapter piece of an illustrative embodiment.
Figure 3C:
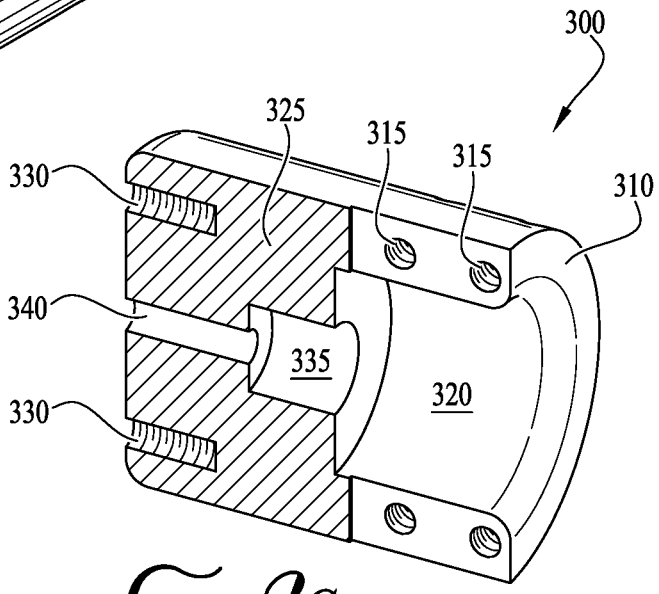
FIG. 3C is a cross sectional view across line 3C-3C of FIG. 3A of an indicator-end adapter piece of an illustrative embodiment.

FIGS. 3A-3C illustrate an indicator-end adapter piece of illustrative embodiments. Indicator-end adapter 300 may be substantially cylindrical and/or tubular in shape with one closed end 345, and one open end circumferentially defined by inner edge 310. Indicator-end adapter 300 may include a pair of axial slots 305 extending from inner edge 310 axially towards the center of indicator-end adapter 300, and radially through the thickness of the wall of hollow portion 320 of the adapter 300 body. In some embodiments, two axial slots 305 may be set 180° apart, although one, three, four or another similar number of slots 305 may be employed. A set and/or plurality of apertures 315 may extend radially into the body of indicator-end adapter 300 adjacent to slot 305. Screws 600 (shown in FIG. 6) inserted into apertures 315 may tighten indicator-end adapter 300 around indicator-end terminal 605 (shown in FIG. 6) of fuse 500 (shown in FIG. 5). Compression of slots 305 when screws 600 are inserted may provide indicator-end adapter 300 tension to clamp around indicator-end terminal 605. In some embodiments, each screw 600 may extend through a pair of apertures arranged on opposing sides of slot 305. In some embodiments, indicator-end adapter 300 may snap-on and/or be secured by an adhesive.

Indicator-end adapter 300 may include hollow portion 320. Hollow portion 320 may provide a female connection to mate snugly with indicator-end terminal 605 and/or cover indicator-end terminal 605. Indicator portion 325 of indicator-end adapter 300 may include an inner diameter that forms piston cavity 335 and needle-shaped channel 340. Axially extending passages 330 may accommodate fasteners 615 (shown in FIG. 6) for attachment of fuse cap 610 (shown in FIG. 6) to indicator-end adapter 300. Fasteners 615 may for example be screws or bolts. Fuse cap 610 may be a three-inch diameter fuse cap 610, for example in UL standard embodiments. Piston cavity 335 may be contiguous with hollow portion 320 and may mate with the outer diameter of piston 700 (shown in FIG. 7), while providing axial space for piston to move between an un-activated position and an overload position.

Figure 4A:
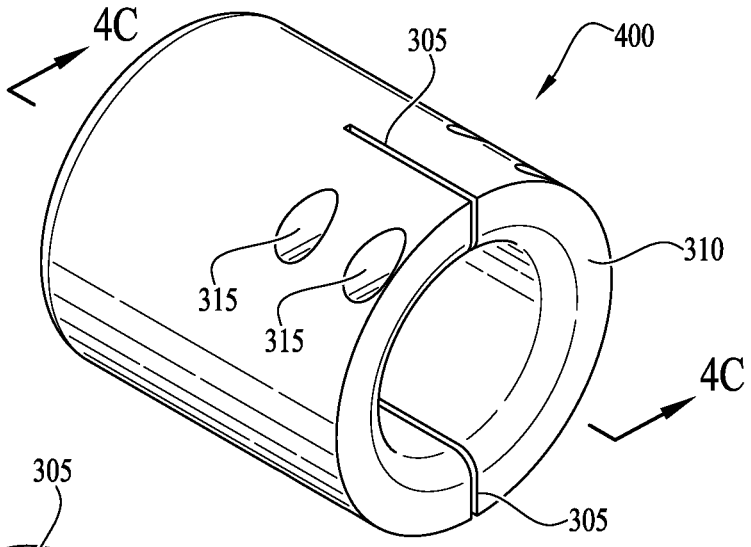
FIG. 4A is a perspective as viewed from the inward side of a non-indicator-end adapter piece of an illustrative embodiment.
Figure 4B:
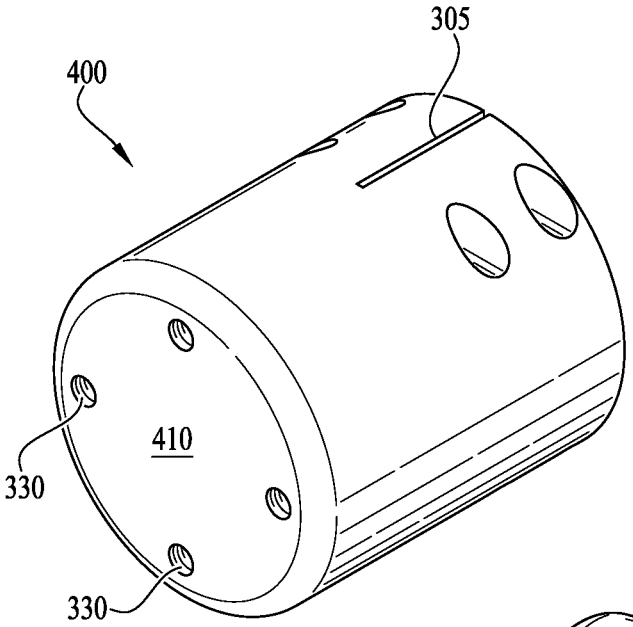
FIG. 4B is a perspective as viewed from the outward side of a non-indicator-end adapter piece of an illustrative embodiment.
Figure 4C:
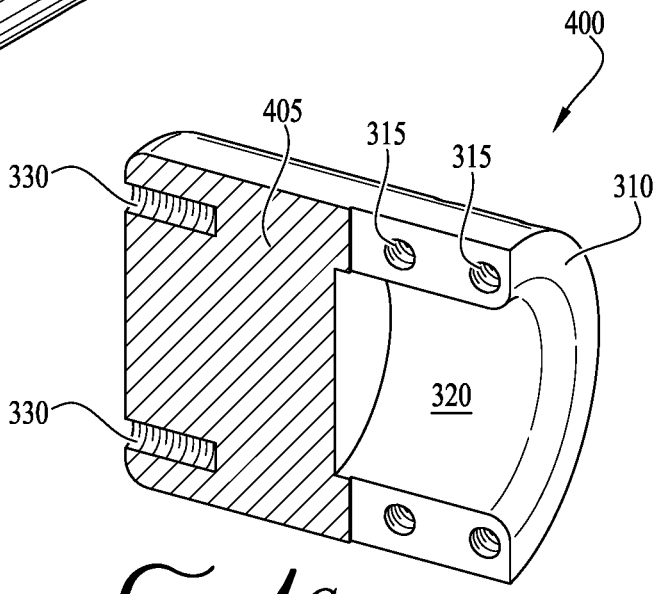
FIG. 4C is a cross-sectional view across line 4C-4C of FIG. 4A of a non-indicator-end adapter piece of an illustrative embodiment.

FIGS. 4A-4C illustrate a non-indicator-end adapter piece of illustrative embodiments. Non-indicator-end adapter 400 may secure around non-indicator terminal 620 (shown in FIG. 6) of fuse 500 (shown in FIG. 5). Non-indicator-end adapter 400 may be similar to indicator-end adapter 300, except rather than indicator portion 325, non-indicator-end adapter 400 may include solid portion 405 and end face 410. Solid portion 405 may provide a base for non-indicator-end adapter 400 to secure to fuse cap 610.

Indicator-end adapter 300 and non-indicator-end adapter 400 may be 360 brass and silver plated to ensure good electrical conductivity. Silver plating may be 0.0001 inches thick and may be applied after machining and prior to attachment of adapters 300, 400 onto fuse 500. In one non-limiting example, to form a 15.5 kV E-rated fuse size D from standardized IEC fuse 500, adapters 300, 400 may each be about 3.19 inches in length and about 2.872 inches in outer diameter. Passages 330 may be about 0.750 inches deep.

Figure 5:
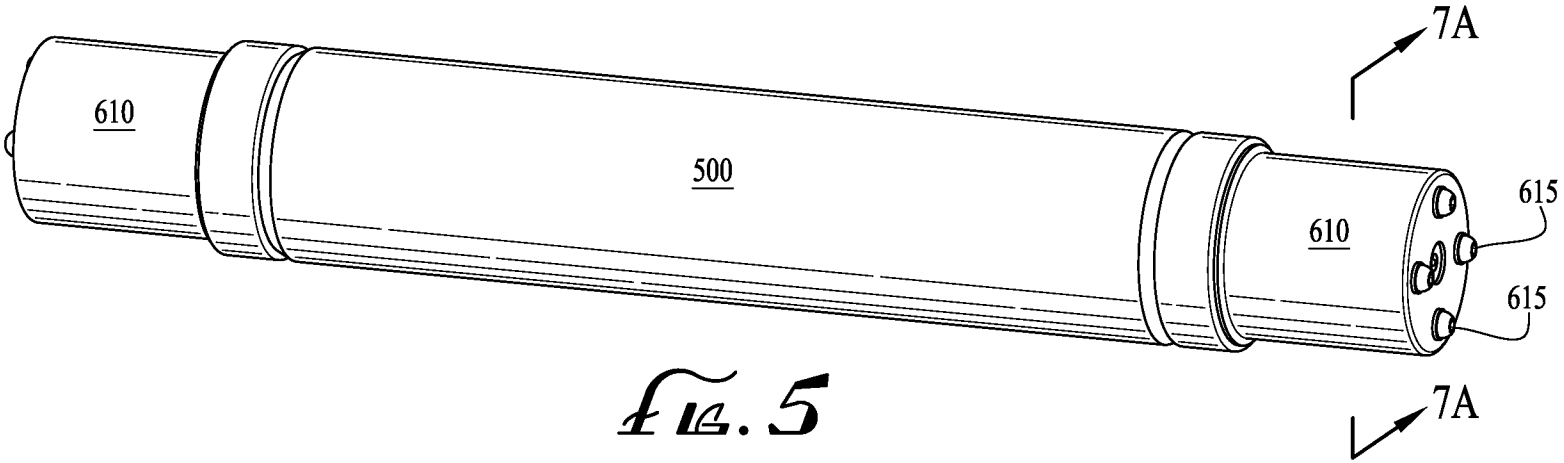
FIG. 5 is a perspective view of an IEC fuse with attached adapter of illustrative embodiments.

FIG. 5 illustrates a fully assembled fuse 500 modified with adapters 300, 400 attached and end caps 610 secured over adapters 300, 400. As shown in FIG. 5, fuse 500 may match fuse clip dimensions of single-barrel UL mounting 800 (shown in FIG. 8). Fuse 500 may be an IEC standardized Ferrule-style fuse of 15,000 Volts and 125, 150, 175 or 200 Amperes. Fuse 500 may be available from Eaton Corporation plc of Dublin, Ireland, Littlefuse, Inc. of Chicago, Ill., USA, or Mersen SA of La Défense, France.

Figure 6:
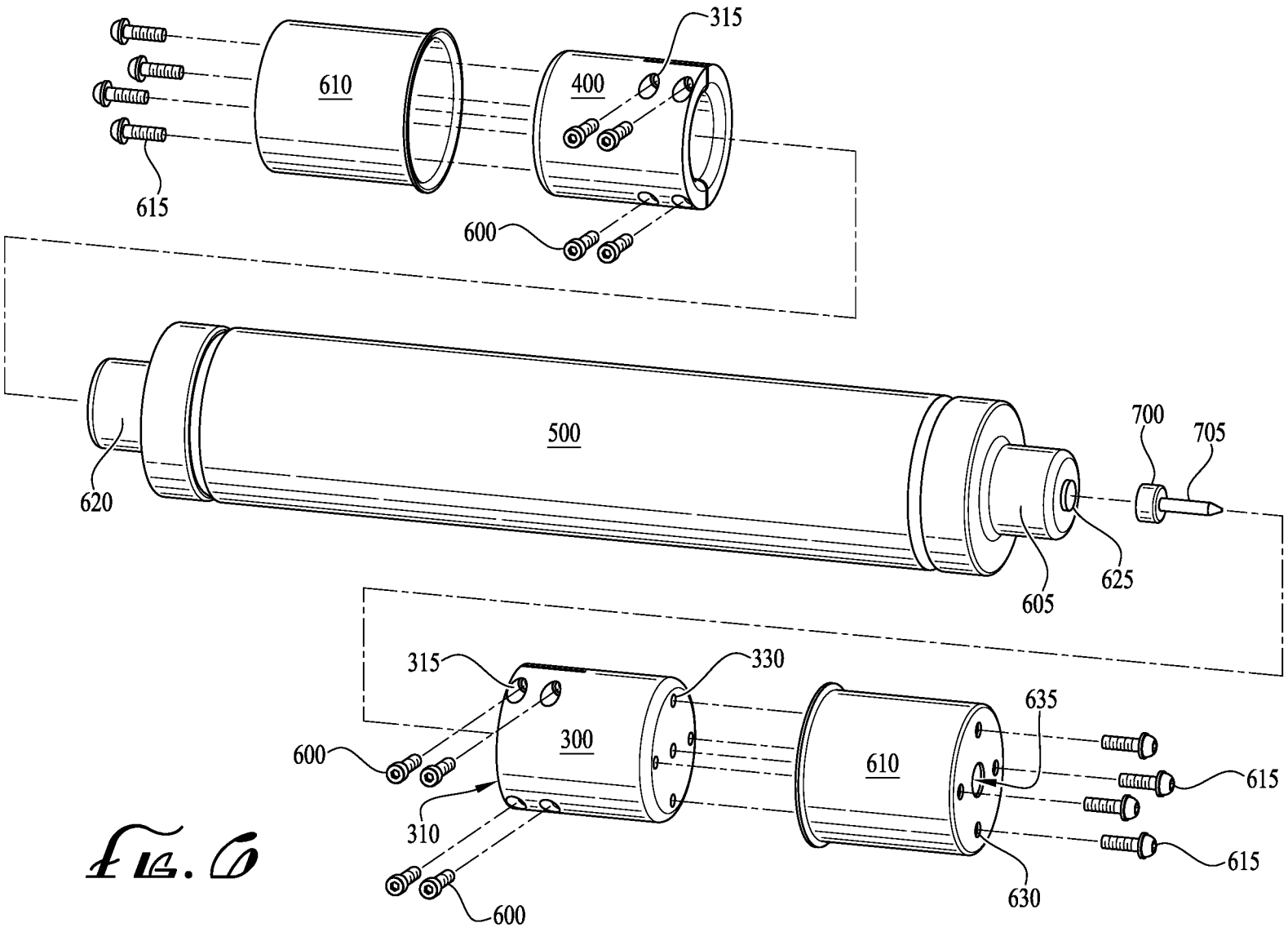
FIG. 6 is an exploded view of an IEC fuse with attached adapter of illustrative embodiments.

FIG. 6 is an exploded view of fuse 500 illustrated in FIG. 5. Prior to attachment of adapters 300, 400, fuse 500 may be shaped similarly to a rolling pin. Striker 625 may be included on indicator-end terminal 605. When fuse 500 overloads, striker 625 may pop out of indicator-end terminal 605 and is designed to be visible so that an operator may observe overload has occurred. However, adapter 300, when employed, may cover striker 625 so striker 625 is no longer visible even when extended. To alleviate this problem, piston 700 and needle 705 may be axially aligned with striker 625 and/or piston may nest over striker 625. Fuse cap 610 may be screwed over adapter 300. Fuse cap 610 on indicator-end of fuse 500 may include central opening 635 to allow needle to extend through and be visible outside of fuse cap 610 when fuse 500 becomes overloaded. Fuse cap 610 may include holes 630 that align with passages 330 to allow fasteners 615 to extend through both holes 630 and passages 330 and secure fuse cap 610 to adapter 300, 400.

Figure 7A:
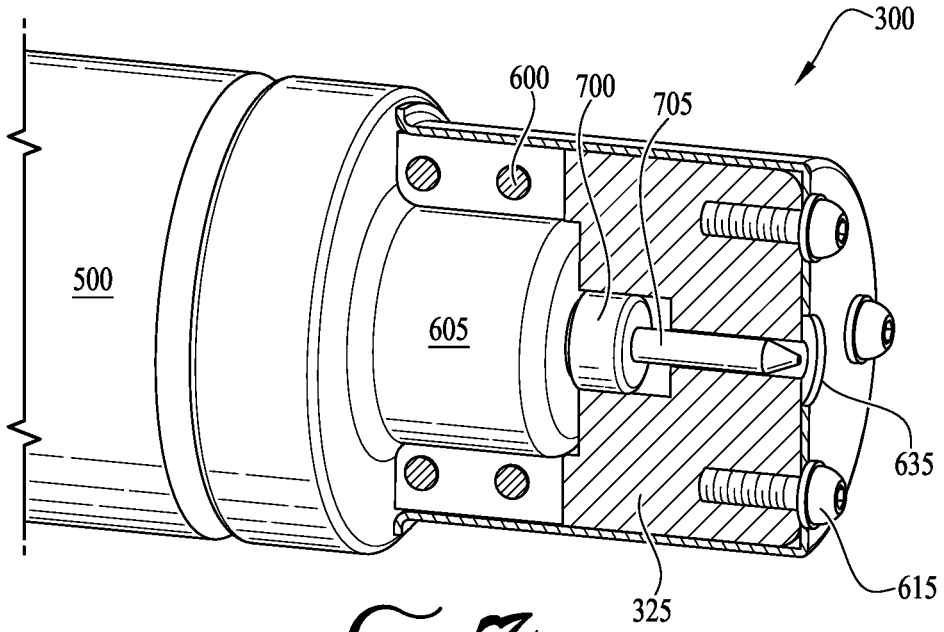
FIG. 7A is a partial cross-sectional view across line 7A-7A of FIG. 5 of an exemplary indicator-end adapter with a piston and needle of illustrative embodiments in an unactivated position.
Figure 7B:
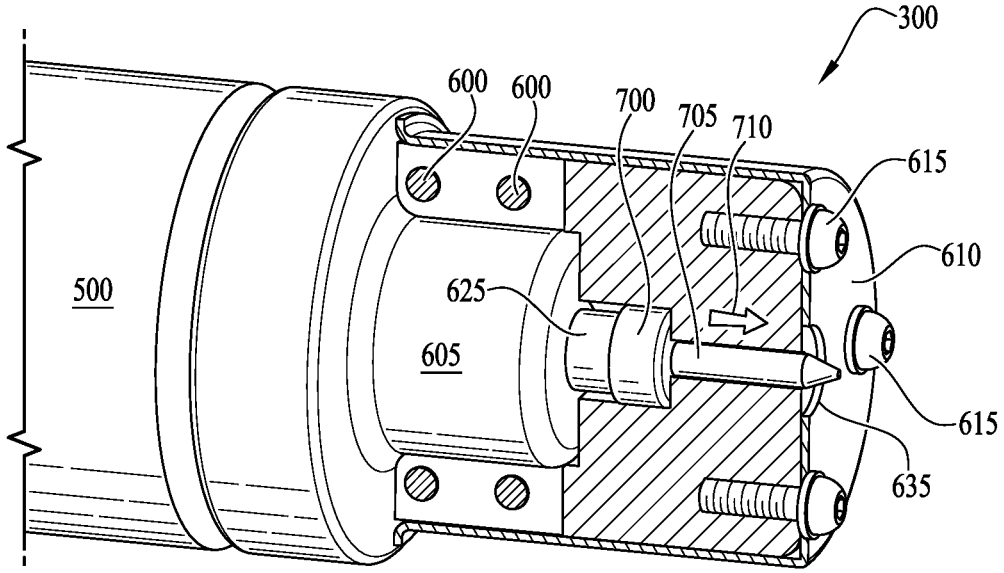
FIG. 7B is a partial cross-sectional view of an exemplary indicator-end adapter with a piston and needle of illustrative embodiments in an overload position.

FIG. 7A and FIG. 7B illustrate the action of striker 625, piston 700 and needle 705 in the event of overload of fuse 500. Piston 700 may be placed over and around the end portion of striker 625, such that striker 625 may nest inside of piston 700. In some embodiments, piston 700 may rest against the face of striker 625 with piston 700 adjacent to striker 625. In certain embodiments, movement and/or extension of striker 625 may initiate movement of piston 700 and/or needle 705 and/or striker 625 may cause a chain reaction that actuates and/or moves piston 700 and/or needle 705. For example, striker 625 may exert force upon piston 700, which piston 700 in turn may move needle 705 such that needle 705 is visible outside fuse cap 610 upon overload of fuse 500. In some embodiments, piston 700 may be secured, attached and/or coupled on and/or tightly around striker 625, such as by friction fit.

In illustrative embodiments, piston 700 may be aluminum and needle 705 may be 300 series stainless steel in one non-limiting embodiment. In exemplary embodiments, needle 705 may be about 1.670 inches in length, and needle 705 and piston 700 assembled length may be about 1.8 inches. The length of needle 705 and piston 700 should be such that needle 705 does not extend and/or is not visible outside fuse cap 610 if fuse 500 is not broken, and alternatively visible outside fuse cap 610 if fuse 500 overloads. In some embodiments, needle 705 may be attached to piston 700 with a threaded connection.

Upon overload, striker 625 may extend outward from fuse 500 in the direction of arrow 710, as shown in FIG. 7B. Piston 700 may be pushed outward and/or actuated by striker 625, which in turn may extend needle 705 outward and through channel 340 such that needle extends through opening 635 in fuse cap 610. Needle 705 may therefore be visible upon overload of fuse 500 and function as a visible indicator of overload. Piston cavity 335 may provide space to allow piston 700 to actuate between an un-activated position and an overload position.

Figure 8:
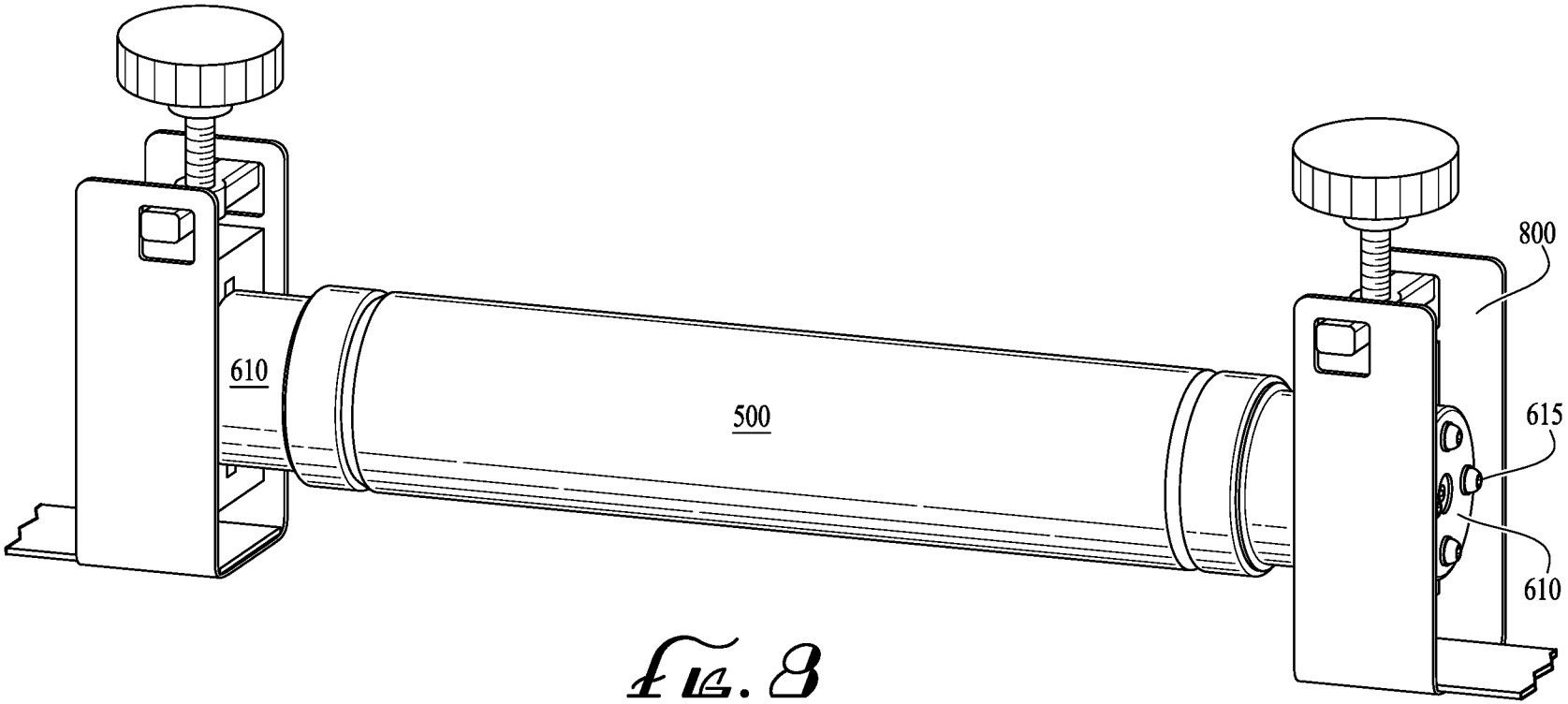
FIG. 8 is a perspective view of an exemplary IEC fuse with adapter of illustrative embodiments fit into a UL style mounting.

FIG. 8 illustrates a fuse with adapter of illustrative embodiments mounted in a CLE/CLS UL style fuse clip mounting. Terminal ends 605, 620 of fuse 500 are enclosed within adapters 300, 400 and fuse caps 610. Mounting 800 fuse clip connections may match fuse clip dimensions of the single-barrel North American design whilst using an IEC standardized fuse 500. The final fuse assembly (for example, MVE15/XXXA-CLE) as shown in FIG. 8 may be constructed using bolts 615 and hand tools. A resistance reading of fuse 500 may be conducted prior to assembly and after assembly to ensure the characteristic of the final product have not changed.

Illustrative embodiments may enable the utilization of IEC style fuses in North American equipment. Illustrative embodiments may convert the physical dimensions of an IEC fuse design without inhibiting the functioning of the fuse or interfering with the visible indication of overload of the fuse. Illustrative embodiments may conserve resources by replacing a single fuse where two fuses would otherwise be required. Those of skill the art may appreciate that the adapter system of illustrative embodiments may be employed with other voltages and currents other than 15,000 Volts.

A high voltage fuse adapter system and method has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A high voltage fuse adapter system comprising:

an indicator-end adapter configured to circumferentially enclose an indicator-end terminal of a high voltage International Electrotechnical Commission (IEC)-rated fuse, comprising:

a hollow portion having an inner diameter that surrounds the indicator-end terminal, the hollow portion comprising at least one axially extending slot compressible around the indicator-end terminal; and an indicator portion;

a piston and needle enclosed within the indicator portion, the piston and needle coupled to a striker of the high voltage IEC-rated fuse such that upon extension of the striker, the piston at least partially actuates the needle outside of the indicator-end adapter;

a non-indicator-end adapter configured to circumferentially enclose a non-indicator-end terminal of the high voltage fuse; and a pair of end caps enclosing the indicator-end adapter and the non-indicator end adapter to form an adapted fuse;

wherein the adapted fuse is configured to fit in an Underwriters Laboratory (UL)-style fuse mounting.

2. The high voltage adapter system of claim 1, wherein the hollow portion of the indicator-end adapter covers the indicator-end terminal.

3. The high voltage adapter system of claim 1, wherein a first end cap of the pair of end caps encloses the indicator-end adapter, the first end cap having an opening, and wherein the needle extends through the opening when actuated by the piston.

4. The high voltage adapter system of claim 1, wherein the hollow portion mates with the indicator-end terminal, and the indicator portion extends on an outward side of the indicator-end adapter.

5. The high voltage adapter system of claim 1, wherein the at least one axially extending slot comprises two axially extending slots arranged 180 degrees apart.

6. The high voltage adapter system of claim 1, wherein the indicator-end adapter and the non-indicator-end adapter are silver plated.

7. The high voltage adapter system of claim 1, wherein the piston is threadedly connected to the needle, and the piston extends circumferentially around an outer diameter of the striker.

8. The high voltage adapter system of claim 1, wherein the at least one axially extending slot is compressible by at least one radially-oriented screw extending through an aperture in the indicator-end adapter.

9. The high voltage fuse adapter system of claim 1, wherein the high voltage IEC-rated fuse is an IEC standardized Ferrule-style fuse of 15.5 kV Volts and one of 125, 150, 175 or 200 Amperes.

10. The high voltage fuse adapter system of claim 9, wherein the UL-style fuse mounting is a CLE/CLS UL style fuse clip mounting.

11. The high voltage fuse adapter system of claim 1, wherein the non-indicator end adapter further comprises a second at least one axially extending slot compressible around the non-indicator-end terminal.

12. A method of employing a single International Electrotechnical Commission (IEC) fuse in an Underwriters Laboratory (UL)-style fuse mounting, comprising:

enclosing an indicator-end of the single IEC fuse inside a first adapter piece that lengthens and widens the indicator-end;

coupling a piston and needle to a striker of the single IEC fuse such that the needle is visible outside the adapter when the single IEC fuse breaks;

enclosing the non-indicator-end of the single IEC fuse inside a second adapter piece;

capping the first and second adapter pieces with end caps; and mounting the single IEC fuse with adapters and end caps into the UL-style mounting.

13. The method of claim 12, further comprising compressing the first adapter piece around the indicator end to mate a hollow portion of the adapter piece to the indicator end.

14. The method of claim 12, wherein the striker of the single IEC fuse actuates the needle at least partially out of the adapter when the single IEC fuse breaks.

15. The method of claim 12, further comprising silver-plating the first and second adapter piece.

16. The method of claim 12, further comprising taking a resistance reading subsequent to enclosing the indicator-end and the non-indicator end of the single IEC fuse inside the first adapter piece and the second adapter piece.

17. The method of claim 12, further comprising employing the mounted single IEC fuse in a phase of a North American style disconnect switch.

18. A system for utilizing an International Electrotechnical Commission (IEC)-rated fuse in North American style equipment comprising a pair of adapter pieces that compressibly mate around respective terminals of the IEC-rated fuse such that the IEC-rated fuse is configured to fit within a pair of Underwriters Laboratory (UL) standard fuse caps and an indicator is visible outside at least one adapter piece of the pair of adapter pieces and its corresponding UL standard fuse cap upon overload of the IEC rated fuse.

* * * * *